US010968679B2

(12) United States Patent
Combe

(10) Patent No.: US 10,968,679 B2
(45) Date of Patent: Apr. 6, 2021

(54) AUTOMATIC SMOKE/CARBON MONOXIDE EVACUATION METHOD AND SYSTEM

(71) Applicant: CoEvac, LLC, Southlake, TX (US)

(72) Inventor: Dan Combe, Southlake, TX (US)

(73) Assignee: COEVAC, LLC, Southlake, TX (US)

( * ) Notice: Subject to any disclaimer, the term of this patent is extended or adjusted under 35 U.S.C. 154(b) by 226 days.

(21) Appl. No.: 15/629,815

(22) Filed: Jun. 22, 2017

(65) Prior Publication Data

US 2018/0264299 A1 Sep. 20, 2018

Related U.S. Application Data

(60) Provisional application No. 62/472,425, filed on Mar. 16, 2017, provisional application No. 62/474,054, filed on Mar. 20, 2017.

(51) Int. Cl.
*E05F 15/72* (2015.01)
*E05F 15/77* (2015.01)
(Continued)

(52) U.S. Cl.
CPC ..... *E05F 15/72* (2015.01); *A62C 2/12* (2013.01); *A62C 2/24* (2013.01); *A62C 3/14* (2013.01); *E05F 15/77* (2015.01); *G08B 17/10* (2013.01); *G08B 21/14* (2013.01); *A62C 2/00* (2013.01); *A62C 3/00* (2013.01);
(Continued)

(58) Field of Classification Search
CPC .. E05F 15/72; E05F 15/77; A62C 2/12; A62C 2/24; A62C 3/14; A62C 3/00; A62C 2/00; G08B 21/14; G08B 17/10; E05Y 2400/80; E05Y 2800/42; E05Y 2400/66;
(Continued)

(56) References Cited

U.S. PATENT DOCUMENTS 4,197,675 A 4/1980 Kelly
4,977,818 A * 12/1990 Taylor ..... A62C 2/12 454/342

(Continued)

OTHER PUBLICATIONS

International Search Report and Written Opinion received in corresponding Patent Cooperation Treaty Application No. PCT/US2018/022521, dated May 31, 2018, 9 pages.

*Primary Examiner* — Ryan W Sherwin
(74) *Attorney, Agent, or Firm* — Wei Wei Jeang; Grable Martin Fulton, PLLC

(57) ABSTRACT

An automatic smoke/carbon monoxide evacuation system for a building having at least one existing ventilation fan and at least one ventilation passageway to outside the building is provided. The system includes a microprocessor and a smoke/carbon monoxide sensor coupled to the microprocessor and configured to detect presence of smoke/carbon monoxide and send a trigger signal to the microprocessor in response to detecting smoke/carbon monoxide. A power switch is coupled to the existing ventilation fan and is configured to automatically connect the existing ventilation fan to a power source in response to the trigger signal, so that the ventilation fan rotates at a high speed to ventilate the detected smoke/carbon monoxide via the existing ventilation passageway. An alarm device is further communicably coupled to the microprocessor and is configured to issue an alarm in response to the trigger signal.

37 Claims, 8 Drawing Sheets

(51) Int. Cl.

| | |
|---|---|
| ***G08B 17/10*** | (2006.01) |
| ***G08B 21/14*** | (2006.01) |
| ***A62C 2/12*** | (2006.01) |
| ***A62C 2/24*** | (2006.01) |
| ***A62C 2/06*** | (2006.01) |
| *A62C 2/00* | (2006.01) |
| *A62C 3/00* | (2006.01) |
| *F04D 27/00* | (2006.01) |

(52) U.S. Cl.
CPC ..... *E05Y 2201/422* (2013.01); *E05Y 2400/66* (2013.01); *E05Y 2400/80* (2013.01); *E05Y 2400/814* (2013.01); *E05Y 2400/818* (2013.01); *E05Y 2800/42* (2013.01); *E05Y 2900/106* (2013.01); *F04D 27/00* (2013.01)

(58) Field of Classification Search
CPC ..... E05Y 2400/814; E05Y 2400/818; E05Y 2201/422; E05Y 2900/106; F04D 27/00
See application file for complete search history.

(56) References Cited

U.S. PATENT DOCUMENTS

| | | | | |
|---|---|---|---|---|
| 5,300,923 | A * | 4/1994 | Gruber | G08B 17/10 126/299 R |
| 5,955,031 | A | 9/1999 | King, Jr. | |
| 6,307,478 | B1 * | 10/2001 | Thompson | G08B 21/14 340/627 |
| 7,183,933 | B2 | 2/2007 | Dzurko et al. | |
| 2005/0078003 | A1 | 4/2005 | King | |
| 2009/0124189 | A1 | 5/2009 | Barber | |
| 2010/0105311 | A1 | 4/2010 | Meneely, Jr. | |
| 2010/0231394 | A1 * | 9/2010 | Finchum | G08B 21/14 340/632 |
| 2013/0281004 | A1 * | 10/2013 | Batayneh | G08B 21/14 454/343 |
| 2015/0015401 | A1 * | 1/2015 | Wedig | G08B 17/10 340/577 |
| 2015/0269821 | A1 * | 9/2015 | Haynes | G08B 17/10 340/532 |

* cited by examiner

AUTOMATIC SMOKE/CARBON MONOXIDE EVACUATION METHOD AND SYSTEM

RELATED APPLICATIONS

The present application is related to co-pending U.S. Non-Provisional patent application Ser. No. 15/629,808, entitled Automatic Smoke/Carbon Monoxide Evacuation Method and System for a Garage filed concurrently on Jun. 22, 2017. The present application also claims the benefit of U.S. Provisional Patent Application No. 62/472,425 filed on Mar. 16, 2017 and U.S. Provisional Patent Application No. 62/474,054 filed on Mar. 20, 2017, both of which are incorporated herein by reference.

FIELD

The present disclosure primarily relates to an automatic smoke and carbon monoxide evacuation method and system for a building or structure.

BACKGROUND

Statistics show thousands of people die from residential fires and smoke inhalation every year in the United States. In fact, most fire deaths are not caused by burns, but by inhaling deadly smoke and fumes generated by the fire. The synthetic materials that are common in today's homes produce a toxic stew of lethal gases that can be deadly even in small quantities. The combination of reduced oxygen and the presence of toxic smoke can quickly obscure escape routes and incapacitate occupants so that they become unconscious and cannot exit the building. In typical situations, smoke from a fire is detected by conventional smoke detectors which sound alarms, but the smoke is retained inside the home until the fire burns through the rooftop. By then, the integrity of the building structure is compromised and the building is in danger of collapse. Existing air-handling systems merely recirculate the smoke and do not evacuate the smoke. Therefore, critical time passes as smoke accumulates inside the building, creating a deadly hazard for the occupants. Without immediate rescue efforts, occupants often fatally succumb to the smoke.

Another silent killer inside the home is carbon monoxide (CO). A typical home is typically outfitted with many appliances and equipment that burn carbon-based fuels such as natural gas and emit carbon monoxide as a byproduct. For one reason or another, this odorless and colorless gas can be inadvertently retained inside the home rather than properly exhausted outside the home. Because the symptoms of carbon monoxide poisoning mimic those of the flu, early signs of carbon monoxide exposure are often overlooked or dismissed. Carbon monoxide's deadly effects are fast-acting, and people who are asleep or intoxicated are especially vulnerable. The CDC estimates that an average of 430 people die from unintentional carbon monoxide exposure in the United States every year. About 3000 people are treated each year for unintentional non-fire related carbon monoxide exposure. Even healthy people who survive exposure to high levels of carbon monoxide can be left with permanent heart or brain damage. Tragically, people also commit suicide by carbon monoxide poisoning using automobile exhaust. Many such cases of suicide by carbon monoxide poisoning have resulted in the collateral killing of family members, who have been inside homes when the excess carbon monoxide from a running vehicle continues to fill a residence. More recently, cases of inadvertent carbon monoxide deaths arise from cars equipped with keyless ignition accidentally left running in the garage. Occupants of a home or building, if still awake or conscious, can heed the alarm of a carbon monoxide detector, but these devices do nothing to alleviate the dangerous condition.

With these statistics, it's evident that current measures to prevent smoke inhalation and carbon monoxide poisoning are insufficient. Current homes and other structures do not have an automatic way to address the presence of smoke and carbon monoxide.

DETAILED DESCRIPTION

A primary goal of the various embodiments of the present system and method is to automatically and actively ventilate smoke and/or carbon monoxide (hereinafter referred to as smoke/carbon monoxide) outside a building upon detection by using existing evacuation pathways already present in the building structure or by retrofitting ventilation pathways. These existing pathways include existing exhaust ducts of internal ventilation fans, vent hood, clothes dryer, water heater, furnace, etc. that allow exhaust air from the combustible fuel-burning equipment/appliances, bathroom, kitchen, laundry room, basement, etc. to be vented to the outside. In the case of a fire, the expedient venting of smoke to the outside allows the neighbors and the general public to observe the smoke and alert the authorities. In another embodiment, the present system and method utilizes existing garage door openers to automatically open the garage door upon detection of smoke/carbon monoxide in the garage to create a pathway for the toxic gases to escape. Exterior audible and/or visual alarms may be used to alert neighbors and the general public. In all cases, the automatic and active venting of dangerous smoke/carbon monoxide will save countless lives.

Figure 1:
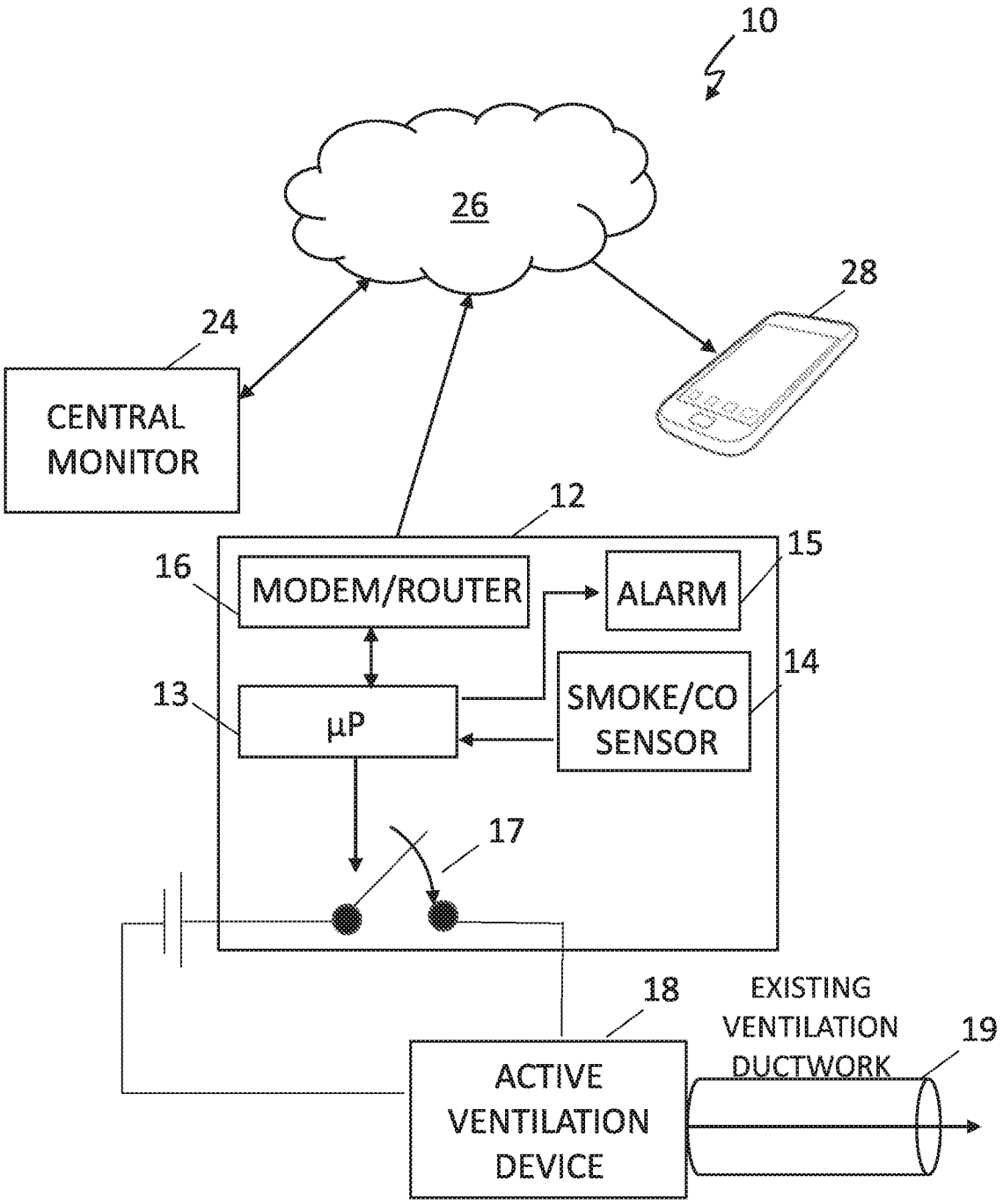
FIG. 1 is a simplified block diagram of an exemplary embodiment of an automatic smoke and carbon monoxide evacuation system according to the teachings of the present disclosure.

FIG. 1 is a simplified block diagram of an exemplary embodiment of an automatic smoke and carbon monoxide evacuation system 10 according to the teachings of the present disclosure. The components of the system 10 include a smoke/carbon monoxide activated switch 12, that includes a microprocessor 13 in communication with a smoke/carbon monoxide sensor 14, an audible/visual alarm 15, and a wireless (or wired) modem/router/transceiver (using WiFi, cellular, Bluetooth, Zigbee or another wireless technology) 16. The smoke/carbon monoxide activated switch 12 further includes a power switch 17, which is coupled to one or more fixed or variable speed ventilation devices or blowing fans 18, which ventilate air via existing or retrofitted ductwork of the building that form ventilation/exhaust passageways 19 to the outside.

In operation, the smoke/carbon monoxide activated switch 12 preferably includes a combined smoke and carbon monoxide sensor 14 that incorporate technology for detecting both the presence of smoke and carbon monoxide in the environment as known in the art or to be developed in the future. Alternatively, the sensor 14 may be dedicated to detecting only one type of hazardous substance, such as smoke, carbon monoxide, radon, etc. A home can use a combination of different types of sensors strategically. Upon sensing the presence of smoke and/or carbon monoxide exceeding a predetermined level, the smoke/carbon monoxide sensor 14 generates a trigger signal that is received by the microprocessor 13, which automatically causes the power switch 17 to close to provide power (AC or DC) to and activate the ventilation device(s), blower(s), or fan(s) 18. The operation of the ventilation device 18 causes the smoke/carbon monoxide detected in the environment to be automatically drawn in and actively evacuated to the outside via the existing ventilation ductwork 19. Additionally, the microprocessor 13 causes the audible/visual alarm 15 to be set off to alert occupants in the building. A loud sound, recorded message, and/or strobe lights can be used. Alternatively, the recorded message and/or the strobe light can be programmed to indicate whether it is smoke or carbon monoxide that has been detected. For example, the strobe light may be red for smoke and blue for carbon monoxide. More sophisticated systems may additionally have the ability to provide more information, such as issuing an audible warning that gives the location of the problem, e.g., "Carbon monoxide detected in the kitchen, evacuate now!" Optionally, the system includes alarms located outside the building (connected wired or wirelessly to the microprocessor 13) so that neighbors and the general public can be alerted of the emergency.

In the preferred embodiment, the smoke/carbon monoxide activated switch 12 can be used to replace or compliment a conventional switch used to control the operation of a ventilation fan, such as a wall-mounted flip or toggle switch. The power switch 17 can be manually manipulated to turn on the ventilation fan, as well as being controlled by the microprocessor 13 in response to the presence of harmful fumes in the environment detected by the smoke/carbon monoxide sensor 14. Retrofitted in this manner, most homes can be easily outfitted with this safety feature to automatically and actively vent deadly smoke and carbon monoxide to the outside.

Additionally, the microprocessor 13 may generate a signal that causes an audible and/or visible alarms 15 co-located (integrated) with and/or located remotely from the smoke/carbon monoxide activated switch 12 to produce an audible and/or visible alert to inform the occupants of the building. Optionally, the microprocessor 13 may be in communication with a plurality of sensors and alarms and can notify one or more selected alarms in the building to issue a visual/audible alarm even if their respective associated sensors have not yet detected smoke/carbon monoxide. The alert can be a loud sound, siren, warning message, flashing lights, etc. that would capture the occupants' attention and instruct them to exit the building.

The smoke/carbon monoxide activated switch 12 may also include a wireless or wired modem/router/transceiver (using WiFi, cellular, Bluetooth, Zigbee or another wireless technology) 16 that may send data to a central monitor 24 via the Internet and/or telecommunication network 26 that may then relay the information to fire rescue and emergency response authorities. A mobile phone (or another type of mobile device) 28 with a downloaded app may be configured to receive wireless notifications from the central monitor 24 or from the microprocessor 13 directly so that an alert can be communicated to a user via the mobile phone's interfaces (display, speaker, vibrator, etc.) depending on the user's preferences in the form of text messages, email, flashing display, or other forms of communication. The notification to the central monitor 24 and mobile devices 28 may include the location, e.g., basement, upstairs bedroom, garage, etc., where the smoke or carbon monoxide was detected. These notifications provide an added layer of safety alerts to users that may or may not be currently on-site at the time of the emergency.

For the most part, the disclosed method and system 10 use existing ventilation/exhaust passageways 19 to evacuate the smoke/carbon monoxide. In particular, each potential source of carbon monoxide in the home (or another type of building structure) is provided with an automatic smoke/carbon monoxide detection and evacuation strategy so that upon detection of the presence of smoke/carbon monoxide emitted by the equipment, the hazardous gas is automatically vented outside of the home/building so that the danger is automatically alleviated or mitigated. In those combustible fuel-operated appliances or equipment where a blower motor (power vent motor, induced draft fan, ventilation fan, etc.) or another type of ventilation device is currently located, a carbon monoxide sensor and power relay switch 12 may be installed to automatically provide power in order to automatically force out smoke/carbon monoxide that is present, even when the appliance or equipment is in the OFF position. Common sources of carbon monoxide gas in a home include: gas or oil burning furnaces, heaters, and boilers; gas water heaters (both tank and tank-less water heaters); gas and wood burning fireplaces; gas ranges, ovens, and cooktops; gas clothes dryers; wood stoves; power generators; motor vehicles; and power tools and lawn equipment.

Although not the focus of the present disclosure, the detection and automatic evacuation of other hazardous gaseous substances such as radon gas in the home is also contemplated herein. In this instance, a radon gas sensor is used to detect the presence of radon gas and automatically activate ventilation blowers and/or fans to evacuate the radon gas through existing or retrofitted ventilation ductwork. Alternatively, sensor 14 is capable of detecting the presence of smoke, carbon monoxide, radon gas, and possibly other harmful substances.

In an alternate embodiment, the smoke/carbon monoxide activated switches and sensors within a home or facility are all in wireless (or wired) communication with each other.

The switches and sensors may also be in communication with a remote or on-site central controller that may coordinate the activation of one or more selected ventilation devices depending on the location of detected smoke/carbon monoxide so that the noxious gases can be optimally evacuated in the most efficient and expedient manner.

Figure 2:
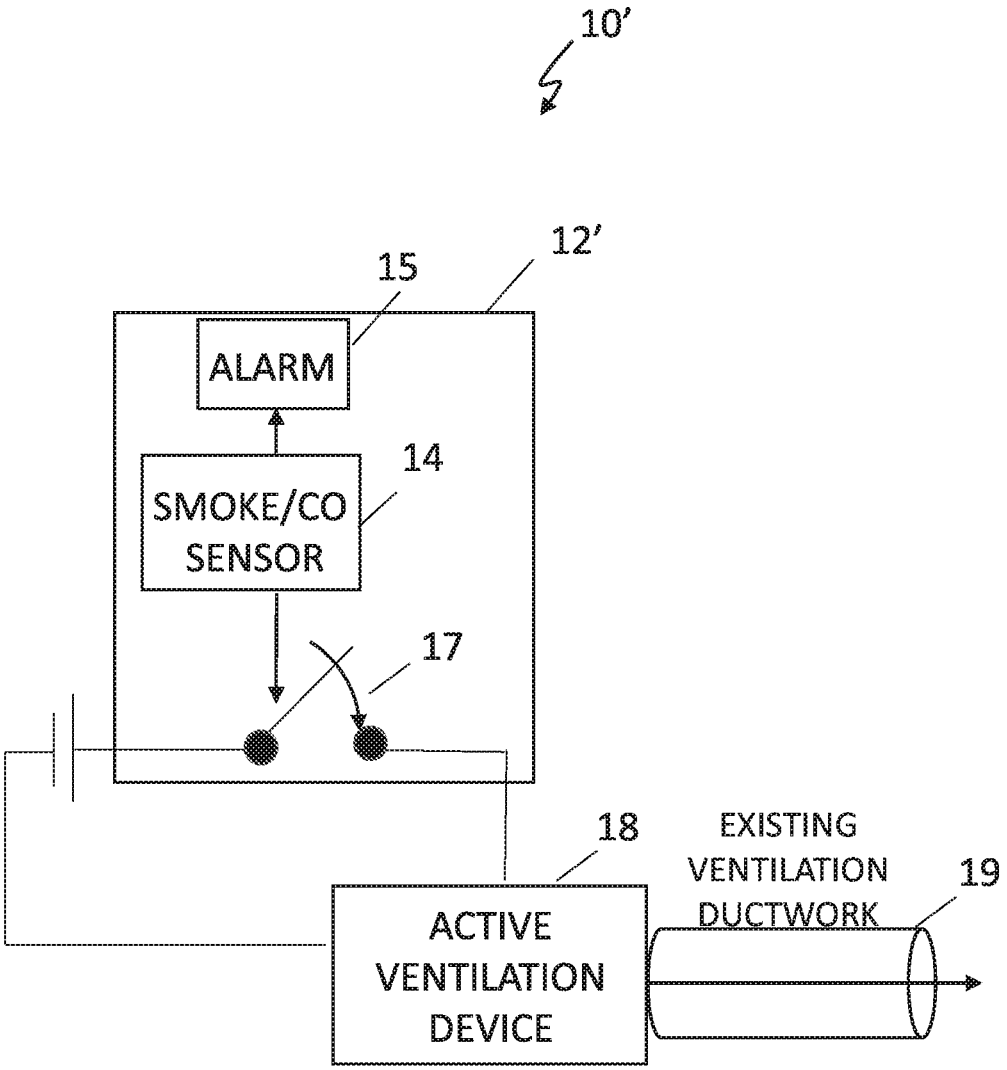
FIG. 2 is a simplified block diagram of another exemplary embodiment of an automatic smoke and carbon monoxide evacuation system according to the teachings of the present disclosure.

The carbon monoxide sensor, activation switch, fan, and alarm may be integrated into a single housing or they may be separate devices coupled to one another or in communication with one another. In one exemplary embodiment shown in FIG. 2, the smoke/carbon monoxide sensor 12' may be integrated with a wall-mounted toggle switch that is used to turn on/off an existing ventilation fan in a bathroom. Upon detection of smoke/carbon monoxide, the sensor 14 causes the power switch 17 to turn on the ventilation fan 18, which draws the smoke/carbon monoxide in and evacuates it via existing ductwork 19. In this embodiment, the only alteration needed to an existing ventilation fan setup is replacing the wall-mounted manual switch that controls the operation of the ventilation fan. A user may still use the wall-mounted manual switch to turn on and off the ventilation fan, but in the event of smoke/carbon monoxide detected in the environment, the manual setting of the switch would be overridden to turn on the ventilation fan to actively evacuate the toxic gases. In this manner, all existing ventilation fans, exhaust fans, and gas appliances in the home are retrofitted with automatic detection and evacuation mechanisms that automatically activate with the presence of smoke/carbon monoxide, in addition to sounding an alarm and/or flashing lights. This alternate embodiment omits the inclusion of the microprocessor and modem/router/transceiver if communication with a central monitor or mobile device is not required or desired. As in the other embodiment described above, the smoke/carbon monoxide sensor 14 causes the audible/visual alarm 15 to be set off to alert occupants inside the building, and optionally outside the building. The alarm 15 can be co-located or integrated with the smoke/carbon monoxide sensor 14 or be remotely located but in wired/wired communication with the sensor.

Figure 3:
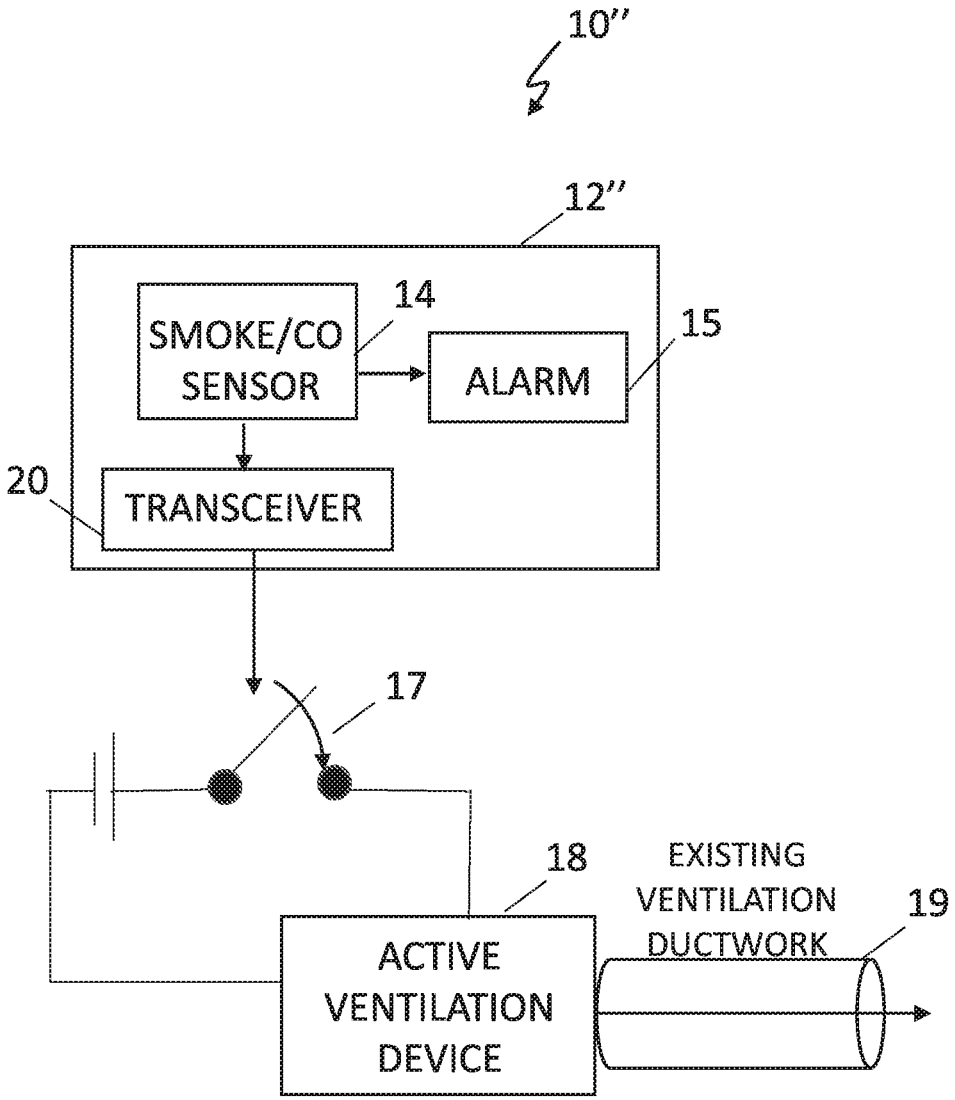
FIG. 3 is a simplified block diagram of yet another exemplary embodiment of an automatic smoke and carbon monoxide evacuation system according to the teachings of the present disclosure.

FIG. 3 is a simplified block diagram of yet another exemplary embodiment of an automatic smoke and carbon monoxide evacuation system 10" according to the teachings of the present disclosure. The system 10" includes a smoke/carbon monoxide sensor 14 that generates a signal upon detection of smoke/carbon monoxide. The generated signal is received by a wireless transceiver 20 that is in wireless communication with a power switch 17 associated with the active ventilation device 18. The transceiver 20 causes the power switch 17 to close, thus automatically activating the ventilation device 18 and vents the detected hazardous air outside the building via existing ductwork 19. At the same time, the smoke/carbon monoxide sensor 14 also sends a signal to the alarm 15, which may be co-located or located remotely from the sensor, and causes it to generate an audible/visual alarm.

Figure 4:
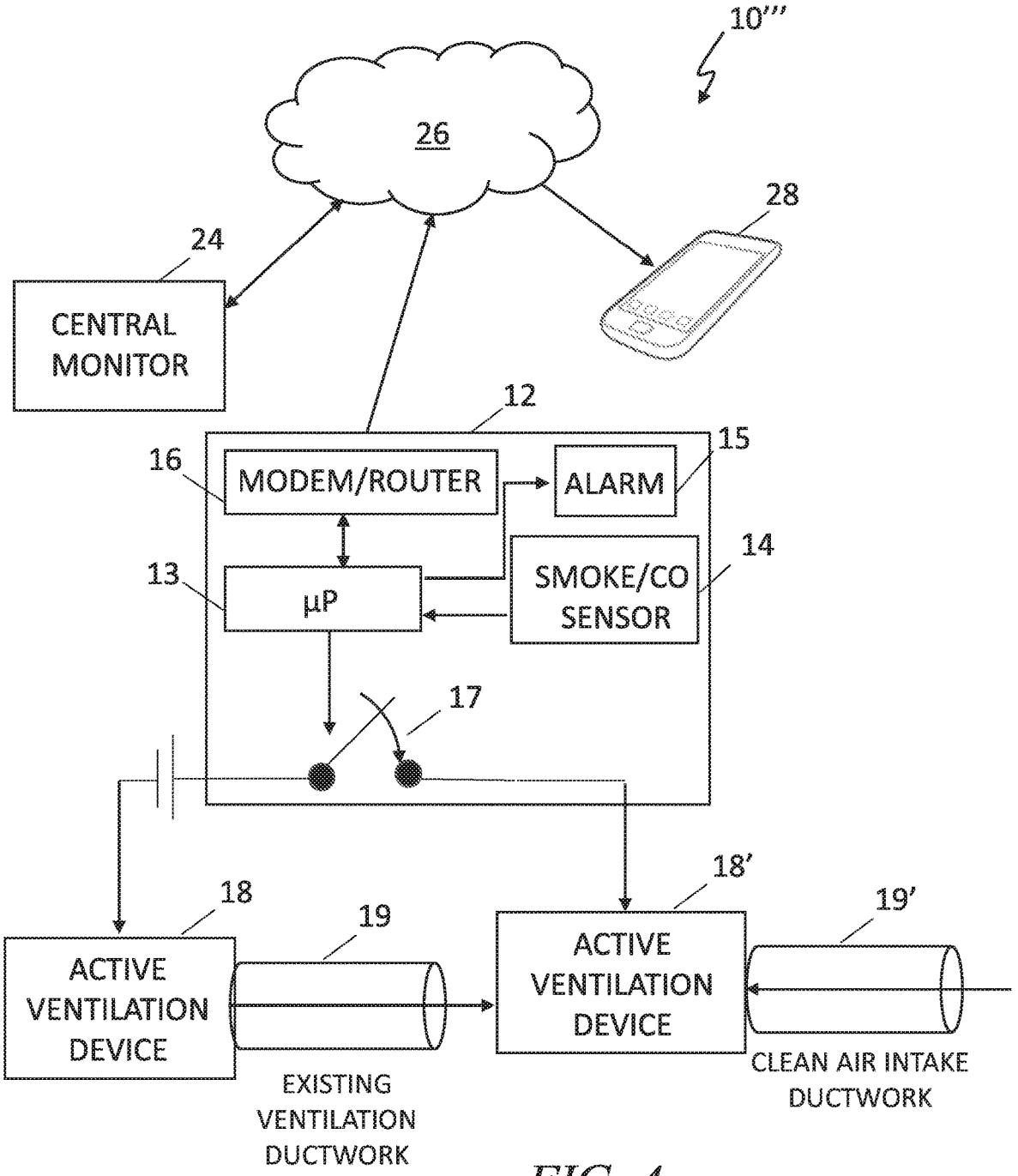
FIG. 4 is a simplified block diagram of another exemplary embodiment of an automatic smoke and carbon monoxide evacuation system automatically incorporating an air intake system according to the teachings of the present disclosure.

FIG. 4 is another simplified block diagram of an exemplary embodiment of an automatic smoke and carbon monoxide evacuation system 10'" according to the teachings of the present disclosure. The smoke/carbon monoxide activated switch 12 includes a smoke/carbon monoxide sensor 14, audible/visual alarm 15, and a wired/wireless modem/router/transceiver 16, which forms a connection with a power switch 17 for one or more fixed or variable speed ventilation devices or blowing fans 18 and 18'. Upon sensing the presence of smoke and/or carbon monoxide exceeding a predetermined level, the smoke/carbon monoxide sensor 14 generates a signal that is received by the microprocessor 13, which sends a wireless signal to automatically close the power switch 17 and activate the ventilation device 18. The automatic operation of the ventilation devices 18 causes the smoke/carbon monoxide detected in the environment to be drawn in and actively evacuated to the outside via existing ventilation ductwork 19. Ideally, a properly insulated and constructed home should have combustible fuel-burning equipment and appliances isolated from the living spaces that people occupy so that the air between the two do not mix. However, many homes are not built with these considerations and may lack adequate mechanical ventilation to properly vent hazardous air and bring in fresh air. Accordingly, in addition to evacuating the harmful gases, the present disclosure also includes the automatic closure of the power switch 17 to further activate another set of ventilation device 18' that draws in clean outside air from the intake ductwork 19', as shown in FIG. 4. Adequately ventilated in this way, the activation of ventilation devices 18 to evacuate the harmful gases would not create a vacuum inside the home.

Figure 5:
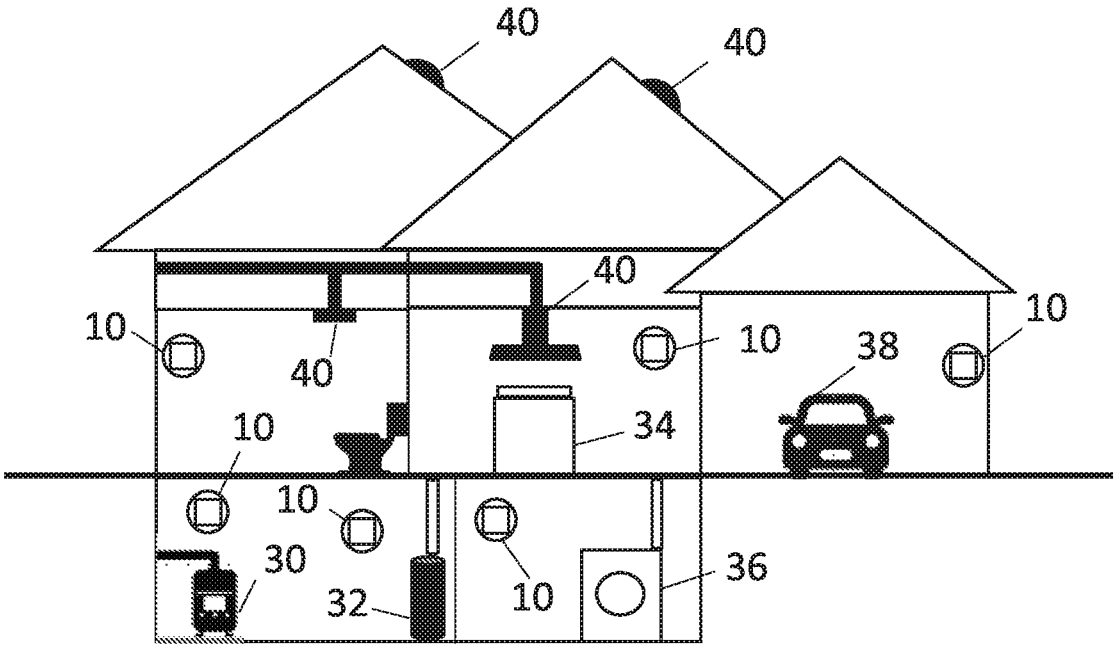
FIG. 5 is a diagram illustrating the architecture of a typical residential building in which automatic smoke and carbon monoxide evacuation system and method are deployed according to the teachings of the present disclosure.

FIG. 5 is a diagram illustrating the architecture of a typical residential building in which automatic smoke and carbon monoxide evacuation system and method 10 are deployed according to the teachings of the present disclosure. In a typical home, many rooms are already equipped with means of ventilation to the outside, such as kitchen, bathroom, laundry room, utility room, water heater closet, and basement. In the home, common sources of carbon monoxide gas include anything that burns a carbon-based fuel, for example, gas and oil furnaces 30, heaters, and boilers; gas and oil water heaters (both tank and tank-less water heaters) 32; gas and wood burning fireplaces; gas ranges, ovens, and cooktops 34; gas clothes dryers 36; wood stoves; and motor vehicles 38. According to the disclosure herein, the location of each carbon monoxide source incorporates a smoke/carbon monoxide evacuation strategy. As most of the carbon monoxide sources are already equipped with exhaust ductwork and ventilation fans 40, the system and method 10 of the present disclosure automatically activates one or more of the fans 40 in case of detected smoke/carbon monoxide.

For example, in the case of a gas stove or fireplace application, a smoke/carbon monoxide activated switch 12 is installed behind or near the inbound gas-supply, and is capable of triggering and activating a fan (or increase the fan speed) to actively pull smoke/carbon monoxide from the area around the heat-shield, to the exterior of the building. Secondary lights and alarms may be activated while the evacuation fan is operating and to alert occupants of the building and people outside the building that smoke/carbon monoxide is present. Email, text message, or another form of electronic alert may also be issued to one or more mobile devices to notify the users.

In the case of a combustible fuel dryer, a smoke/carbon monoxide activated switch 12 is located behind or near the inbound combustible fuel burner chamber, and is capable of triggering a fan (or increase the fan speed) to actively pull smoke/carbon monoxide from the area around the dryer, to the exterior of the structure. Secondary lights and alarms may be activated while the evacuation fan is operating to alert occupants of the building that smoke/carbon monoxide is present. Email, text message, or another form of electronic alert may also be issued.

In the case of a gas water heater, a smoke/carbon monoxide activated switch 12 is located proximate the inbound gas-supply line and is capable of triggering a fan (or increase the fan speed) at the outside wall to actively pull smoke/ carbon monoxide from the area around the water heater and evacuate it to the exterior of the structure via existing ductwork. Secondary lights and alarms may be activated while the evacuation fan is operating and to alert occupants of the building that smoke/carbon monoxide is present. Email, text message, or another form of electronic alert may also be issued.

In the case of a gas fireplace, a smoke/carbon monoxide activated switch 12 is located within 24 inches of the inbound gas-supply line at the gas starter access, and is capable of triggering a fan (or increase the fan speed) to actively pull smoke/carbon monoxide to the exterior of the structure through vents, or the chimney above the fireplace. Secondary lights and alarms may be activated while the sensor is tripped and evacuation fans/pumps are operating and to alert occupants of the building that smoke/carbon monoxide is present. Email, text message, or another form of electronic alert may also be issued.

In the case of a combustible furnace application, a smoke/carbon monoxide activated switch 12 is located within 16 inches of the inbound gas-supply line at the exterior of the appliance, and is capable of triggering a fan or blower (or increase the fan speed) to actively pull carbon monoxide to the exterior of the structure through an existing flue gas out vent or chimney. Secondary lights and alarms may be activated while the sensor is tripped and evacuation fans/pumps are operating and to alert occupants of the building that smoke/carbon monoxide is present. Email, text message, or another form of electronic alert may also be issued.

In the case of a gas stove or oven application, a smoke/carbon monoxide activated switch 12 is located near the inbound gas-supply line or near the ventilation hood, and is capable of triggering the fan (or increase the fan speed) in the ventilation hood to actively pull carbon monoxide to the exterior of the structure through an existing flue gas out vent or chimney. Secondary lights and alarms may be activated while the sensor is tripped and evacuation fans/pumps are operating and to alert occupants of the building that smoke/carbon monoxide is present. Email, text message, or another form of electronic alert may also be issued.

In the preferred embodiment of the present disclosure, a ventilation fan may be installed in an existing ventilation passageway if none existed previously. Further, new ductwork may be added to create a ventilation passageway for a particular carbon monoxide source if none existed previously. Further, the smoke/carbon monoxide sensor may additionally activate mechanical intake of clean air for certain applications.

Figure 6:
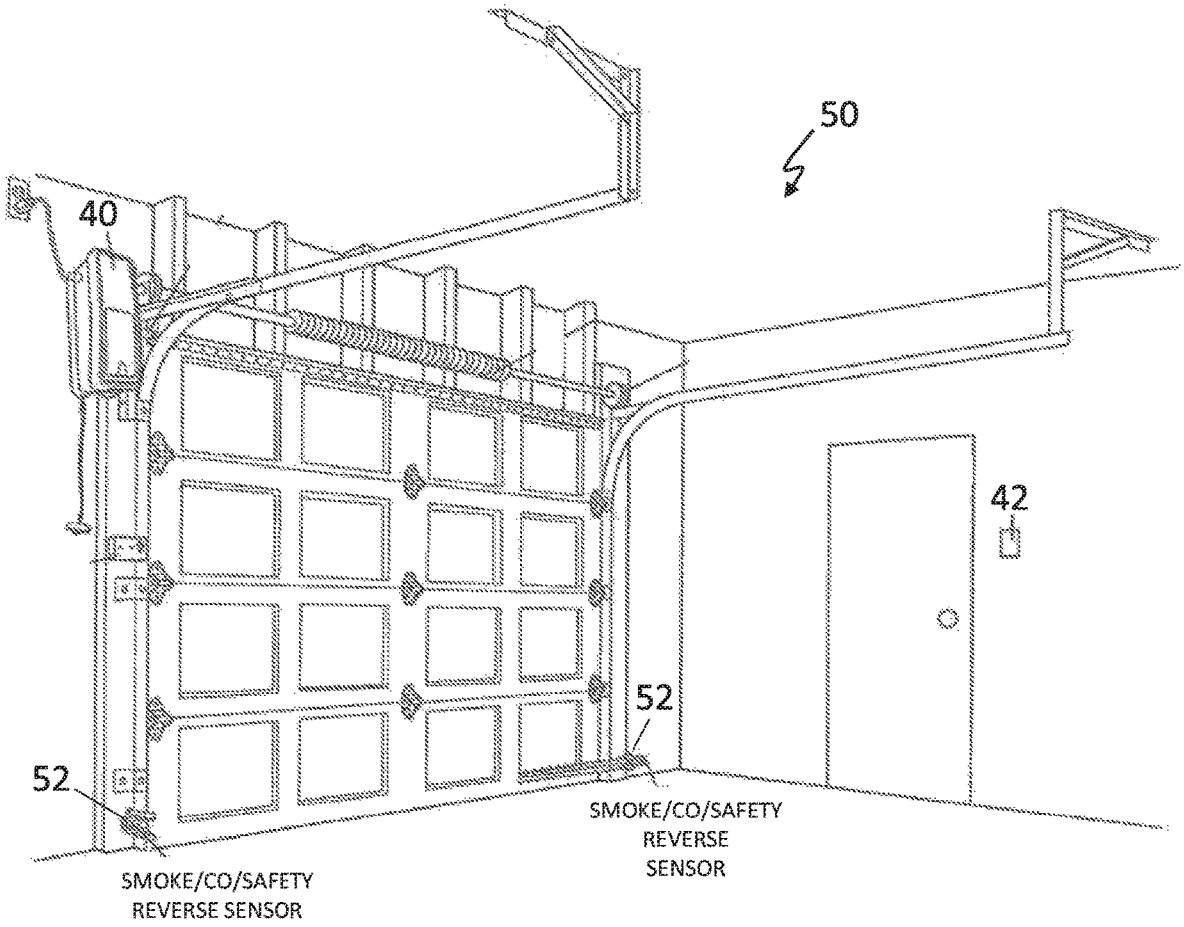
FIG. 6 is a diagram illustrating another exemplary embodiment of an automatic smoke and carbon monoxide evacuation system according to the teachings of the present disclosure.

FIG. 6 is a diagram illustrating another exemplary embodiment of an automatic smoke and carbon monoxide evacuation system 50 according to the teachings of the present disclosure. A source of carbon monoxide inside the home is the automobile that is parked inside the garage that can intentionally or inadvertently cause unnecessary death and injury. The garage is typically equipped with an automated garage door opener with a motor unit 40 (wall-mounted or ceiling-mounted) that can be operated from a remote controller (not shown) or wall-mounted controller 42. The garage door is divided into horizontal sections that have rollers running on a set of tracks. The motor unit 40 is configured to raise and lower the garage door along these tracks. Garage door openers manufactured for the U.S. since 1993 are required to include a safety feature that includes sensors located near the floor on two sides of the garage door that can detect the presence of an object in the path of a closing garage door. In response to detecting an obstruction, the safety sensors cause the motor unit 40 of the garage door to reverses direction and retract the door so that it stays open. These safety sensors are activated to reverse the direction of the garage door when a projected beam across the path of the closing garage door is obstructed by an object. In a preferred embodiment of the present disclosure, a smoke/carbon monoxide activated switch 52 is co-located or integrated with the safety reverse sensors of the garage door opener to open the garage door and keep it open when smoke/carbon monoxide is detected.

Figure 7:
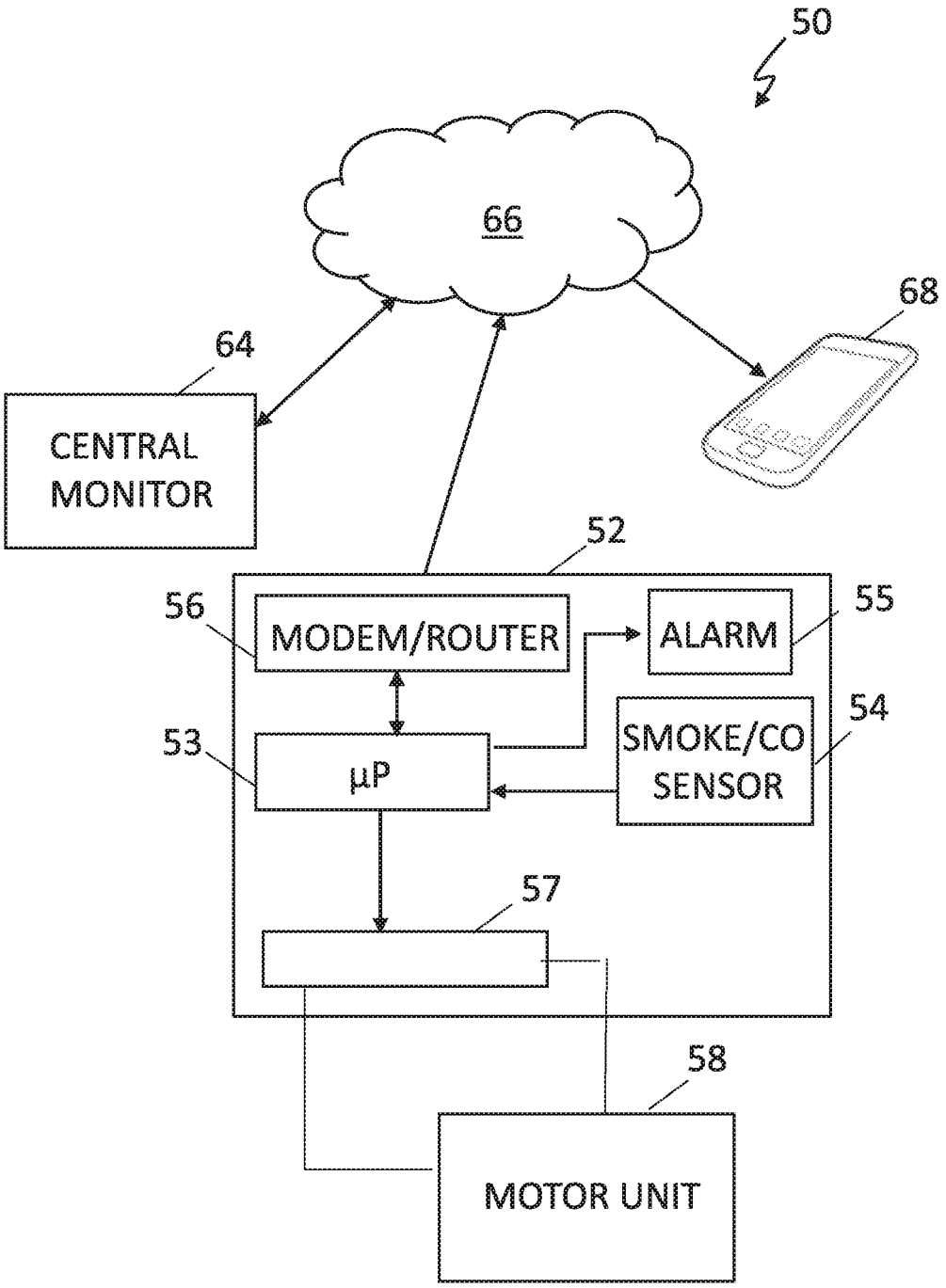
FIG. 7 is a simplified block diagram of another exemplary embodiment of an automatic smoke and carbon monoxide evacuation system according to the teachings of the present disclosure.

FIG. 7 is a simplified block diagram of another exemplary embodiment of an automatic smoke and carbon monoxide evacuation system 50 according to the teachings of the present disclosure. The system 50 includes a smoke/carbon monoxide activated switch 52 that includes a microprocessor 53 in communication with a smoke/carbon monoxide sensor 54, an audible/visual alarm 55, and a wireless transceiver 56. The smoke/carbon monoxide sensor 54 is preferably co-located on one or both sides of the garage door with the safety reverse sensor so that the sensors are optimally located to detect exhaust fumes from a car packed inside the garage. The smoke/carbon monoxide activated switch 52 further includes or is in communication with a power switch 57, which is coupled to the motor unit 58 of the garage door opener. In operation, upon detection of smoke/carbon monoxide, the microprocessor 53 causes the power switch 57 to the motor unit 58 to close and connect to a power source, thus activating the motor unit to open the garage door and keep it open. Once the garage door is open, the microprocessor 53 will temporarily disable the power switch 57 so that subsequent manual manipulation of the wall-mounted switch or remote controller to close the garage door will be ignored as long as the presence of smoke/carbon monoxide is still detected. As in the other embodiments, the microprocessor 53 also generates a signal that causes the audible and/or visible alarms 55 to produce an audible and/or visible alert to inform the occupants of the building. The alert can be a loud sound, siren, flashing lights, etc. that would capture the occupants' attention. The smoke/carbon monoxide activated switch 52 may also include a wireless transceiver (using WiFi, cellular, Bluetooth, Zigbee or another wireless technology) 56 that may send data to a central monitor 64 via the Internet and/or telecommunication network 66 that may then relay the information to fire rescue and emergency response authorities. A mobile phone (or another type of mobile device) 68 with an app may be configured to receive wireless notifications from the central monitor 64 or from the microprocessor 53 directly so that an alert can be communicated to a user via the mobile phone's interfaces (display, speaker, vibrator, etc.) depending on the users' preferences. These notifications provide an added layer of safety alerts to users that may or may not be currently on-site at the time of the emergency.

Accordingly, a smoke/carbon monoxide sensor is incorporated with a garage door opener to enable the automatic opening of the garage door when smoke and/or carbon monoxide is detected in the environment, such as when the engine of a car is left running in the garage and toxic gases are accumulating. The logic programming of the microprocessor 53 enables an override of the manual operation of the switch so that even if a user tries to close the garage door using the wall-mounted switch or remote controller, the garage door would still stay open. Once the garage door is open, the dangerous fumes can be easily evacuated. At the same time, audible and/or visual alarms are set off in addition to alerts sent to a mobile device to notify the occupants of the residence. Notification can also be automatically sent to a central monitor agency or an emergency rescue department. It should be noted that the sensitivity level of the smoke/carbon monoxide sensor is carefully calibrated so that it does not inadvertently trigger false positives and cause the garage door opener to malfunction.

In an implementation for a garage with multiple garage doors, each garage door may be equipped with a smoke/carbon monoxide activated switch to act independently or in a coordinated manner, so that once the sensor of one garage door detects dangerous levels of smoke/carbon monoxide and triggers the opening of one garage door, the other garage door(s) are also retracted regardless of whether the respective smoke/carbon monoxide sensor(s) has detected sufficient levels of the toxic gases.

Figure 8:
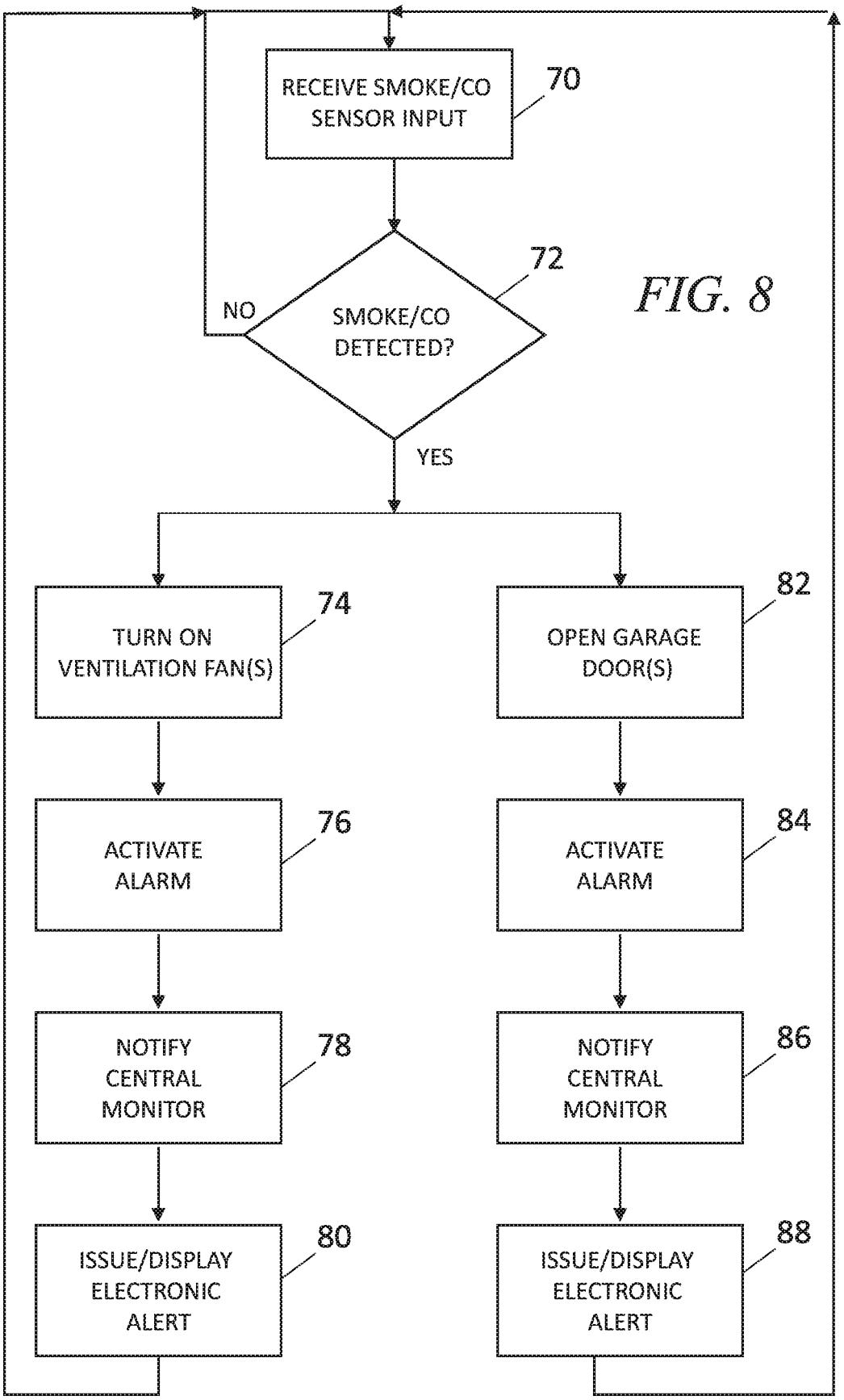
FIG. 8 is a flowchart illustrating an exemplary process of an automatic smoke and carbon monoxide evacuation system according to the teachings of the present disclosure.

FIG. 8 is a flowchart illustrating an exemplary process of an automatic smoke and carbon monoxide evacuation system according to the teachings of the present disclosure. In blocks 70 and 72, the microprocessor of the smoke/carbon monoxide activated switch receives input from the smoke/carbon monoxide sensor and determines whether smoke and/or carbon monoxide has been detected. If not, the process continues to monitor inputs from the smoke/carbon monoxide sensor. If the input from the smoke/carbon monoxide sensor indicates that smoke and/or carbon monoxide is present or approaching a dangerous level, the microprocessor immediately turns on (or increases the fan speed of) one or more ventilation fans so that the deadly gases are forcefully ventilated via existing ductwork, as shown in block 74. Additionally, audible and/or visual alarms are activated to alert occupants of the building, as shown in block 76, and if applicable, a central monitor is notified, as shown in block 78. In block 80, electronic alerts are displayed or issued via a mobile device. The process then loops back to continue to monitor the amount of smoke/carbon monoxide, and to keep the ventilation fan operating if levels are still high.

In the case of the garage door opener embodiment, upon detection of smoke and/or carbon monoxide, the microprocessor activates the motor unit of the garage door opener, and causes one or more garage doors to retract and open, as shown in block 82. Additionally, audible and/or visual alarms are activated to alert occupants of the building, as shown in block 84, and if applicable, a central monitor is notified, as shown in block 86. In block 88, electronic alerts are displayed or issued via a mobile device. The process then loops back to continue to monitor the amount of smoke/carbon monoxide, and to keep the garage door open if levels are still high.

As stated above, a primary goal of the present system and method is to automatically and actively ventilate smoke, carbon monoxide, and/or another harmful substance outside using existing evacuation pathways already present in the building structure to immediately reduce the dangerous level of smoke/carbon monoxide/harmful substance in the environment. This automatic active evacuation scheme can be easily implemented and is cost-effective to retrofit in existing homes and buildings. In all cases, the automatic and active venting of dangerous smoke/carbon monoxide using the present system and method will save countless lives.

The system and method described herein may also incorporate a test button to enable the periodic testing of the functionalities of the smoke/carbon monoxide activated switch. Upon actuating the test button of a smoke/carbon monoxide activated switch, the associated ventilation device(s) is powered up to ensure proper operation. Similarly, the garage door opener embodiment may incorporate a test button that can be used to ensure the proper functioning of the garage door opener.

It should be noted that the power switch component described herein can be thought of as a smart switch or circuit breaker that is "programmed" to direct power to the appropriate target according to whether toxic substances has been detected in the environment. Using this smart power switch or circuit breaker, the ventilation fans and blowers or garage door openers are powered up, turned on, and activated when harmful substances such as smoke, carbon monoxide, or radon are detected to quickly evacuate the deadly gases.

The features of the present invention which are believed to be novel are set forth below with particularity in the appended claims. However, modifications, variations, and changes to the exemplary embodiments of the smoke/carbon monoxide activated sensor system and method described above will be apparent to those skilled in the art, and the system and method described herein thus encompasses such modifications, variations, and changes and are not limited to the specific embodiments described herein.

What is claimed is:

1. An automatic smoke/carbon monoxide evacuation system for a building having at least one existing ventilation fan and at least one existing ventilation passageway to outside the building, comprising:

a microprocessor;

a smoke/carbon monoxide sensor coupled to the microprocessor and configured to detect presence of smoke/carbon monoxide and send a trigger signal to the microprocessor in response to detecting smoke/carbon monoxide;

a replacement power switch integrated with the smoke/carbon monoxide sensor and coupled to the existing ventilation fan, selected from the group consisting of existing bathroom ventilation fans and vent hood, configured to automatically connect the existing ventilation fan to a power source in response to the trigger signal, so that the existing ventilation fan rotates at a high speed to ventilate the detected smoke/carbon monoxide via the existing ventilation passageway selected from the group consisting of existing ductwork of existing bathroom ventilation fans, vent hood, clothes dryer, water heater, and furnace;

an alarm device communicably coupled to the microprocessor configured to issue an alarm in response to the trigger signal; and a transceiver coupled to the microprocessor configured to automatically transmit a wireless notification message to a central monitor in response to the trigger signal.

2. The automatic smoke/carbon monoxide evacuation system of claim 1, wherein the alarm device is configured to issue at least one of audible and visual alarms.

3. The automatic smoke/carbon monoxide evacuation system of claim 1, wherein the alarm device is configured to issue a recorded message indicative of location of detected smoke/carbon monoxide.

4. The automatic smoke/carbon monoxide evacuation system of claim 1, wherein the alarm device is configured to issue a recorded message indicative of the type of hazardous substance detected.

5. The automatic smoke/carbon monoxide evacuation system of claim 1, wherein the alarm device is configured to illuminate light in a first color in response to detection of smoke, and illuminate light in a second color in response to detection of carbon monoxide.

6. The automatic smoke/carbon monoxide evacuation system of claim 1, wherein the alarm device is configured to issue at least one of audible and visual alarms outside of the building.

7. The automatic smoke/carbon monoxide evacuation system of claim 1, wherein the smoke/carbon monoxide sensor is located proximate to a carbon monoxide source inside the building.

8. The automatic smoke/carbon monoxide evacuation system of claim 1, wherein the transceiver is further configured to automatically transmit a wireless notification message to a mobile device via the central monitor.

9. The automatic smoke/carbon monoxide evacuation system of claim 1, wherein the power switch is further coupled to an intake fan configured to automatically connect the intake fan to a power source in response to the trigger signal, so that the intake fan rotates at a high speed to bring in clean outside air via an intake passageway.

10. An automatic smoke/carbon monoxide evacuation system for retrofitting a building having at least one existing ventilation fan and at least one existing ventilation passageway to outside the building comprising:

a smoke/carbon monoxide sensor located proximate to a carbon monoxide source inside the building, and configured to detect presence of smoke/carbon monoxide and generate a trigger signal in response to detecting smoke/carbon monoxide;

a power switch integrated with the smoke/carbon monoxide sensor and communicatively coupled to the existing ventilation fan, selected from the group consisting of existing bathroom ventilation fans and vent hood, configured to automatically connect the existing ventilation fan to a power source in response to the trigger signal, so that the existing ventilation fan is automatically turned on and rotates at a predetermined speed to ventilate the detected smoke/carbon monoxide via the existing ventilation passageway selected from the group consisting of existing ductwork of existing bathroom ventilation fans, vent hood, clothes dryer, water heater, and furnace; and an alarm device coupled to the smoke/carbon monoxide sensor and configured to issue an alarm in response to the trigger signal.

11. The automatic smoke/carbon monoxide evacuation system of claim 10, wherein the smoke/carbon monoxide sensor is located proximate to a carbon monoxide source comprising at least one of a gas furnace, a gas heater, a gas water heater, a gas fireplace, a gas range, a gas oven, a gas cooktop, a gas clothes dryer, a gas pump, and a gas generator.

12. The automatic smoke/carbon monoxide evacuation system of claim 10, wherein the alarm device is configured to issue at least one of audible and visual alarms.

13. The automatic smoke/carbon monoxide evacuation system of claim 10, wherein the alarm device is configured to issue at least one of audible and visual alarms outside of the building.

14. The automatic smoke/carbon monoxide evacuation system of claim 10, further comprising a transceiver configured to automatically transmit a wireless notification message to a mobile device in response to the trigger signal.

15. The automatic smoke/carbon monoxide evacuation system of claim 10, further comprising a transceiver configured to automatically transmit a wireless notification message to a central monitor in response to the trigger signal.

16. The automatic smoke/carbon evacuation system of claim 10, wherein the power switch receives the trigger signal from the smoke/carbon monoxide sensor wirelessly.

17. The automatic smoke/carbon evacuation system of claim 10, wherein the smoke/carbon monoxide sensor and the power switch are in wired communication with one another.

18. An automatic hazardous gas evacuation system comprising:

a hazardous gas sensor integrally incorporated in a wall-mounted toggle switch electrically coupled to an existing ventilation fan configured to detect presence of hazardous gas and generate a trigger signal in response to detecting hazardous gas exceeding a predetermined level; and the existing ventilation fan electrically coupled to the hazardous gas sensor configured to automatically turn on and rotate at a predetermined speed to ventilate the detected hazardous gas through a ventilation passageway in response to the trigger signal.

19. The automatic hazardous gas evacuation system of claim 18, wherein the hazardous gas sensor is positioned proximate to a particular hazardous gas source.

20. The automatic hazardous gas evacuation system of claim 18, further comprising a power switch in communication with the hazardous gas detector and configured to automatically connect the fan to a power source in response to the trigger signal.

21. The automatic hazardous gas evacuation system of claim 18, further comprising an alarm device coupled to the hazardous gas sensor and configured to issue an alarm in response to the trigger signal.

22. The automatic hazardous gas evacuation system of claim 18, wherein the fan is in wireless communication with the hazardous gas sensor.

23. The automatic hazardous gas evacuation system of claim 18, wherein the hazardous gas sensor and the fan are in wired communication with one another.

24. The automatic hazardous gas evacuation system of claim 18, wherein the fan and the hazardous gas sensor communicate directly with one another.

25. The automatic hazardous gas evacuation system of claim 18, wherein the fan and the hazardous gas sensor communicate indirectly with one another.

26. An automatic hazardous gas evacuation system for retrofitting a building with existing ventilation ductwork comprising:

a hazardous gas sensor incorporated in a power switch electrically communicable with an existing ventilation appliance configured to exhaust air via an existing ventilation ductwork, the hazardous gas sensor configured to detect presence of hazardous gas and generate a trigger signal in response to detecting hazardous gas exceeding a predetermined level; and the power switch configured to automatically connect the ventilation appliance to a power source in response to the trigger signal.

27. The automatic hazardous gas evacuation system of claim 26, wherein the ventilation appliance comprises a fan coupled to the power switch and configured to automatically turn on and rotate at a predetermined speed to ventilate the detected hazardous gas through a ventilation passageway in response to the trigger signal.

28. The automatic hazardous gas evacuation system of claim 26, further comprising an alarm device coupled to the hazardous gas sensor and configured to issue an alarm in response to the trigger signal.

29. The automatic hazardous gas evacuation system of claim 26, wherein the power switch is configured to automatically connect a plurality of ventilation appliances to a power source in response to the trigger signal.

30. The automatic hazardous gas evacuation system of claim 26, further comprising a plurality of power switches configured to automatically connect a plurality of ventilation appliances to a plurality of power sources in response to the trigger signal.

31. A method of automatically evacuating hazardous gases inside a building equipped with existing ventilation device and ventilation ductwork, comprising:

sensing, by an integrated power switch and sensor, a presence of the hazardous gases inside the building;

generating a trigger signal in response to sensing the hazardous gases; and automatically activating the existing ventilation device by electrically connecting power to the existing ventilation device by the integrated power switch and sensor to automatically evacuate the hazardous gases via the ventilation ductwork in response to the trigger signal.

32. The method of claim 31, wherein sensing presence of the hazardous gases comprises sensing presence of at least one of smoke, carbon monoxide, and radon.

33. The method of claim 31, further comprising generating at least one of an audible and visible alarm.

34. The method of claim 33, wherein generating the at least one of an audible and visible alarm comprises playing a message identifying the type of detected hazardous gases.

35. The method of claim 33, wherein generating the at least one of an audible and visible alarm comprises flashing a color-coded light to identify the type of detected hazardous gases.

36. The method of claim 31, further comprising transmitting a notification message to a central monitor.

37. The method of claim 31, further comprising transmitting a notification message to a mobile device, and displaying an alert message on the mobile device.

* * * * *